United States Patent [19]

Sondermann

[11] 4,453,589

[45] Jun. 12, 1984

[54] ARRANGEMENT FOR CONTINUOUSLY CASTING A METAL STRAND

[75] Inventor: Karl J. Sondermann, Puerto de la Couz, Spain

[73] Assignee: Voest-Alpine Aktiengesellschaft, Linz, Austria

[21] Appl. No.: 374,960

[22] Filed: May 5, 1982

[30] Foreign Application Priority Data

May 22, 1981 [AT] Austria ..... 2310/81

[51] Int. Cl.[3] ..... B22D 11/00

[52] U.S. Cl. ..... 164/440; 164/442; 164/483; 164/490

[58] Field of Search ..... 164/416, 425–426, 164/440, 442, 478, 490, 483

[56] References Cited

U.S. PATENT DOCUMENTS

| | | | |
|---|---|---|---|
| 1,088,171 | 2/1914 | Pehrson | 164/416 |
| 3,415,306 | 12/1968 | Olsson | 164/416 |
| 3,517,725 | 6/1970 | Watts | 164/416 |

FOREIGN PATENT DOCUMENTS 65715 3/1914 Austria .

OTHER PUBLICATIONS

"Handbuch des Stranggiessens" by Von Dr. Erhard Herrmann.

*Primary Examiner*—Nicholas P. Godici
*Assistant Examiner*—Richard K. Seidel
*Attorney, Agent, or Firm*—Brumbaugh, Graves, Donohue & Raymond

[57] ABSTRACT

An arrangement for continuously casting a metal strand includes a continuous casting mould reciprocating in the longitudinal direction. A casting tube sealed relative to the inner walls of the mould projects into the continuous casting mould. An extraction means for the strand running out of the continuous casting mould is provided. In order to start casting without using a starter bar and by observing the shortest set-up times possible, the mould and the extraction device composed of driving rolls are arranged on a car or sledge that is displaceable to and fro in the longitudinal direction of the continuous casting mould. A coolable closure piece for the mould cavity is insertable and removable between the run-out side end of the mould and the extraction device.

6 Claims, 5 Drawing Figures

ARRANGEMENT FOR CONTINUOUSLY CASTING A METAL STRAND

BACKGROUND OF THE INVENTION

The invention relates to an arrangement for continuously casting a metal strand, in particular a steel strand, comprising a preferably horizontally arranged, continuous casting mould reciprocating in the longitudinal direction, a casting tube projecting into the continuous casting mould and sealed relative to the inner walls of the mould, and an extraction means for the strand running out of the continuous casting mould.

An arrangement of this kind is known from "Handbuch des StranggieBens" (Handbook on Continuous Casting) by Dr. Erhard Herrmann, Aluminium-Verlag GmbH, Düsseldorf, 1958, pages 149 and 150. For starting this arrangement, a starter rod is provided, which is pushed into the mould at the onset of casting. At each oscillation stroke of the mould in the strand extraction direction, the starter rod and, after starting, the cast strand are conveyed therewith by a clamping jaw mounted to the mould. Another, stationarily arranged, clamping jaw serves for securing the starter rod and the strand, respectively, when the mould is being moved back. This known arrangement calls for a starter rod at the onset of casting, the starting of casting thus being time and material consuming. Furthermore, means for enabling the detachment of the starter rod from the cast strand have to be provided. For inserting the starter rod into the continuous casting mould a further device is required. During the insertion the clamping jaws have to be pivoted outwardly in order to be able to push the starter rod in the direction towards the mould and thereinto opposite the strand extraction direction, which involves additional work.

A further disadvantage is to be seen in the fact that two clamping means, i.e., a stationary clamping jaw as well as a clamping jaw arranged on the mould, are necessary.

From U.S. Pat. No. 3,517,725 an arrangement for horizontal continuous casting without using a starter bar is known, in which a mould is provided that is closed on one end and fastened on a carriage. During casting the molten metal continues to flow into the mould through the tube-shaped strand formed. Continuous casting is not possible with this arrangement, because the strand solidifies throughout from a certain strand length, and no melt can thus reach the mould any longer. In practice, difficulties come up when cooling the strand such that the strand skin does not melt and the strand does not freeze up prematurely. Also, the supply of coolant to the mould, which is displaceable over a large path length, involves difficulties.

SUMMARY OF THE INVENTION

The invention aims at avoiding these disadvantages and difficulties, and has as its object to provide an arrangement of the initially defined kind, in which casting may be started without using a starter bar and by observing the shortest set-up times possible, which arrangement, however, is simple in construction and offers a great extent of operational safety.

This object is achieved according to the invention in that the continuous casting mould and the extraction means composed of driving rolls are arranged on a car or sledge that is displaceable to and fro in the longitudinal direction of the continuous casting mould, a coolable closure piece for the mould inner space being insertable and removable between the run-out side end of the continuous casting mould and the extraction means.

According to a preferred, space-saving, embodiment the closure piece of the continuous casting mould is displaceable along a guide directed transverse to the mould axis, from a position closing the continuous casting mould into a position laterally thereof, and vice versa.

To ensure that the strand leaving the mould is most carefully supported, a run-out roller table is provided following the driving rolls in the strand extraction direction, whose rollers, which are arranged immediately after the driving rolls, are removable, preferably lowerable, from the run-out roller table.

In order to be able to achieve a thermal insulation of the metal melt present in the casting tube relative to the strand skin solidified in the mould, the casting tube has a bottom that is provided with at least one outlet for the metal melt.

Suitably, the driving rolls rotate at a constant angular speed $\omega$ that is so large that the product $R \cdot \omega$ is at least as large as the maximum speed of the mould reciprocating at a sinussoidal-like increasing and decreasing speed, R being the radius of the driving rolls.

BRIEF DESCRIPTION OF THE DRAWINGS

The invention will now be explained in more detail with reference to the accompanying drawings, wherein.

DESCRIPTION OF EXEMPLARY EMBODIMENT

Figure 1:
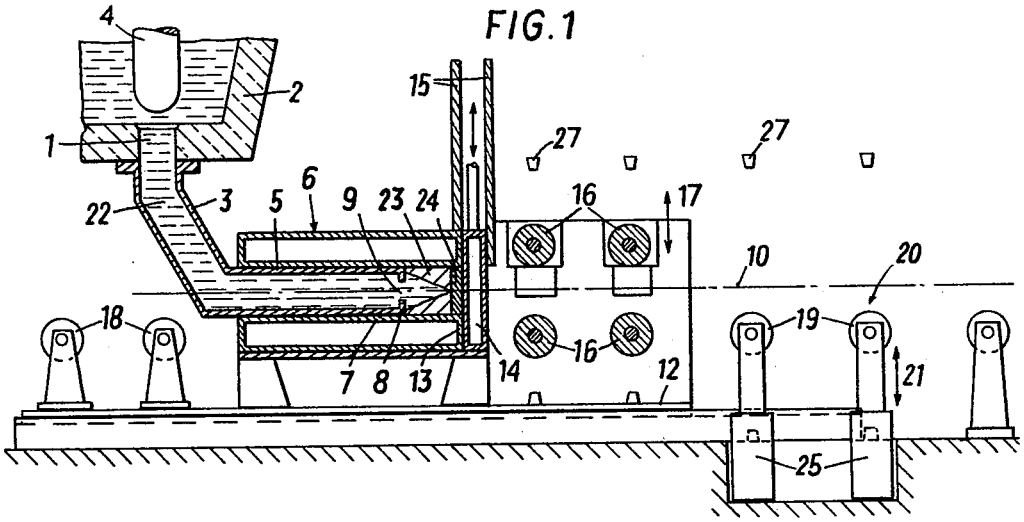
FIGS. 1 to 3 each are vertical sections through the arrangement of the invention in the longitudinal direction of the strand in schematic illustration.

To a bottom outlet 1 of a tundish 2, a knee-shaped casting tube 3 is connected. The bottom outlet 1 is closeable by means of a stopper 4. The casting tube 3 has a long horizontal section 5 projecting into a water-cooled continuous casting mould 6. The external cross section of the horizontal section 5 of the casting tube 3 corresponds to the internal cross section of the continuous casting mould 6. The end 7 of the casting tube is sealed relative to the inner walls of the mould in order to prevent the escape of molten steel, and is provided with a bottom 8 comprising at least one outflow opening 9 for the steel melt.

The axis 10 of the mould 6 extends horizontally. The mould is capable of reciprocating to and fro by a distance 11 (FIG. 2) in the direction of its axis 10, i.e. in its longitudinal direction. For this purpose the mould is mounted on a car 12 displaceable in the horizontal direction, which may be moved to and fro by the distance 11 by driving means (not illustrated). The run-out side end 13 of the mould is closeable by means of a closure piece 14, which is designed as a water-cooled copper bottom in the embodiment illustrated. For the purpose of closing the mould, this bottom 14 is displaceable in a plane perpendicular to the mould axis 10 along guides 15.

On the car 12 an extraction means formed by oppositely arranged driving rolls 16 is further provided, the upper driving rolls 16 being displaceable in the direction of the arrows 17 and thus adjustable to the strand.

For supporting the casting tube 3, if the latter projects into the mould 6 with a slight portion of its length only, supporting rollers 18 are provided on the car 12.

The first two rollers 19 of the run-out roller table 20 are liftable and lowerable in the direction of the arrows 21 in order to make possible the displacement of the car in the lowered position and to be able to support the strand in the lifted position without impediment and without a distance between the supporting sites that is too large.

The arrangement functions in the following manner:

For starting the plant, the car 12 is moved in the direction towards the tundish 2 so that the casting tube 3, with its bottom 8, comes to lie close to the run-out side end 13 of the mould 6 (FIG. 1). The water-cooled bottom 14 of the mould is placed on the mould. After the bottom outlet 1 of the tundish 2 has been opened, steel melt 22 streams into the mould and a strand skin 23 forms within the mould closedly extending also over the bottom 14 of the mould. In order to avoid too great a wear of the bottom 14 of the mould 6, a plate 24 is attached to the bottom. By displacing the mould along the horizontal portion 5 of the casting tube 3 by the path 11 into the position farthest remote from the tundish 2 (FIG. 2), the mould is filled entirely with steel melt and a strand forms whose length extends from the bottom 14 of the mould as far as to the bottom 8 of the casting tube. During the displacement of the mould into the position illustrated in FIG. 2, the rollers 18 that support the casting tube get to below the casting tube. Prior to the displacement of the car 12 into the position illustrated in FIG. 2, the supporting rollers 19 are lowered, which suitably is effected by a hydraulic device 25.

As soon as the strand skin on the bottom 14 of the mould is sufficiently thick to withstand the ferrostatic pressure, the bottom 14 is removed from the mould along its guides 15 in a next step, and the mould 6 is then moved back into the position nearest to the tundish 2, the end 7 of the casting tube 3 urging the strand 26 out of the mould until the strand is seized by the driving rolls 16. After the strand 26 has left the mould 6, it is sprayed with a coolant from nozzles 27 arranged along the strand guide.

Figure 2:
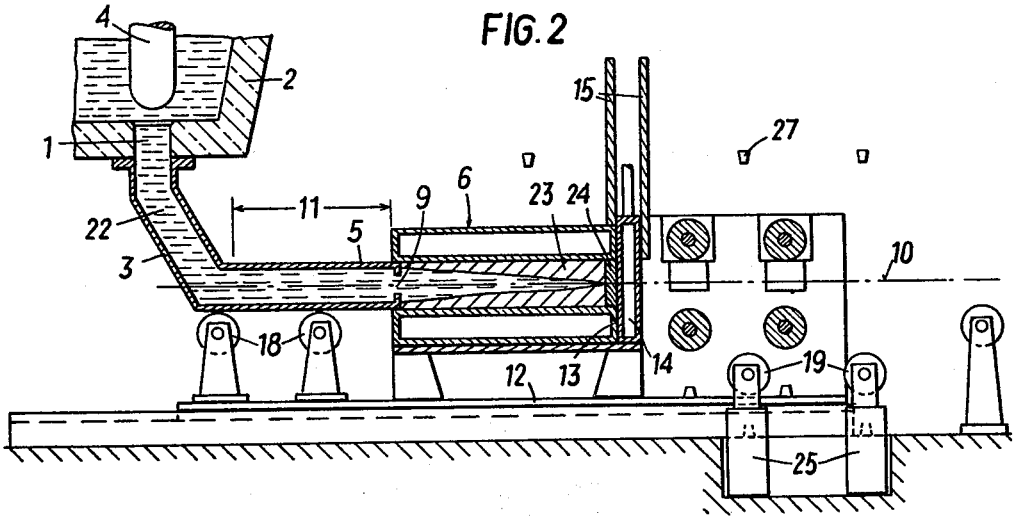
Figure 3:
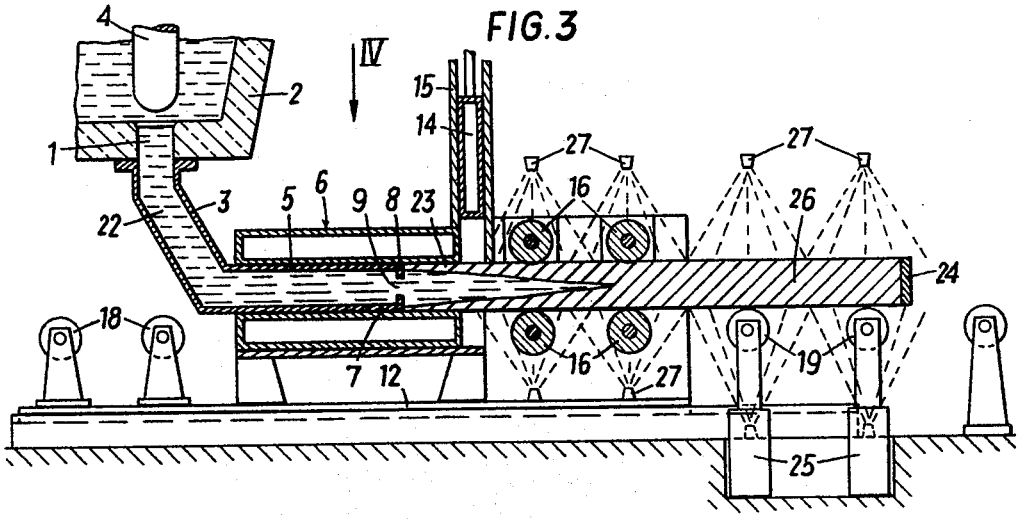
Figure 4:
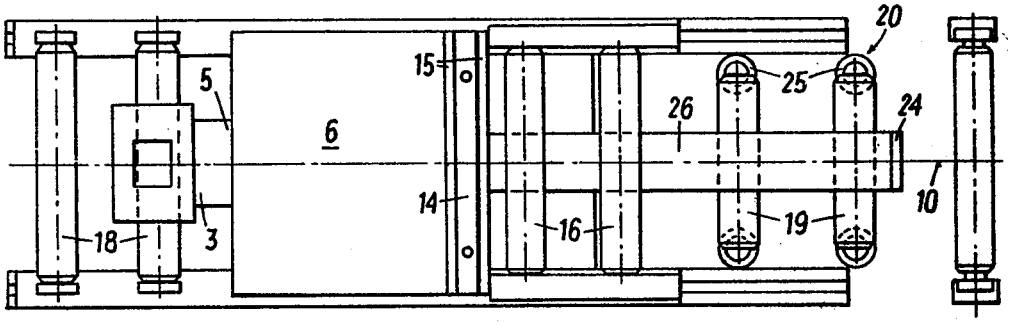
FIG. 4 is a top view of the plant in the direction of the arrow IV of FIG. 3.

The oscillation of the mould 6 along its axis 10 between the positions illustrated in FIGS. 1 and 2 is continuously repeated so that a longer strand will finally project out of the mould, as is illustrated in FIG. 3. In case the mould 6 is in its position nearest to the tundish the rollers 19 are in a lifted position.

Figure 5:
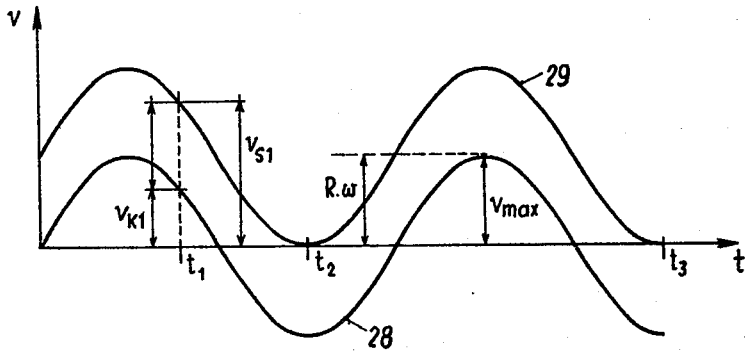
FIG. 5 illustrates the speed course of the strand.

The reciprocating movement of the mould is illustrated in FIG. 5. Against the abscissa of the coordinate system of FIG. 5 the time t and against the ordinate the speed v are plotted. The curve 28 represents the speed course of the mould 6. At the time $t_1$ the mould moves at a speed $v_{K1}$. The driving rolls are driven at a constant angular speed $\omega$, the condition $$R \cdot \omega = v_{max}$$

being observed. Herein, R means the radius of the driving rolls and $v_{max}$ means the highest speed reached by the mould 6. The cast strand 26 therefore is conveyed out at a speed resulting from the addition of the ordinate values of the curve and the constant value $R \cdot \omega$. The speed of the strand is illustrated in FIG. 5 by the curve 29. At the point of time $t_1$ the speed of the strand is denoted by $v_{S1}$. At the points of time $t_2$ and $t_3$ the strand is idle.

If a new strand is to be cast, the bottom may be displaced downwardly into its position closing the mould 6 already at a time at which the end of the strand 26 has passed the bottom 14, whereupon casting a new strand may be started immediately.

The plant according to the invention is particularly suited for small strand formats, preferably for billets and blooms; however, the casting of slabs is also feasible.

What I claim is:

1. In an arrangement for continuously casting a metal strand, in particular a steel strand, of the type including a, preferably horizontally arranged, continuous casting mould reciprocating in the longitudinal direction and having inner walls defining a mould cavity, a casting tube projecting into said continuous casting mould and sealed relative to said inner walls, an extraction means including driving rolls provided for said metal strand as it emerges from a run-out end of said continuous casting mould, and a transporting means including means for moving said transporting means reciprocatingly in the longitudinal direction of said continuous casting mould, the improvement wherein said transporting means comprises means for mounting said continuous casting mould and said extraction means on said transporting means, and wherein the improvement further comprises a coolable closure piece being selectively insertable into and removable from a position between said run-out end and said extraction means for selectively closing and opening said mould cavity; and a guide means directed transverse to the axis of said continuous casting mould, said coolable closure piece being displaceable along said guide means into said position between said run-out end and said extraction means and out of said position to a position located laterally of said mould.

2. In an arrangement for continuously casting a metal strand, in particular a steel strand, of the type including a, preferably horizontally arranged, continuous casting mould reciprocating in the longitudinal direction and having inner walls defining a mould cavity, a casting tube projecting into said continuous casting mould and sealed relative to said inner walls, an extraction means including driving rolls provided for said metal strand as it emerges from a run-out end of said continuous casting mould, and a transporting means including means for moving said transporting means reciprocatingly in the longitudinal direction of said continuous casting mould, the improvement wherein said transporting means comprises means for mounting said continuous casting mould and said extraction means on said transporting means, and wherein said improvement further comprises a coolable closure piece being selectively insertable into and removable from a position between said run-out end and said extraction means in a direction transverse to said longitudinal direction of said mould for selectively closing and opening said mould cavity.

3. In an arrangement for continuously casting a metal strand, in particular a steel strand, of the type including a, preferably horizontally arranged, continuous casting mould reciprocating in the longitudinal direction and having inner walls defining a mould cavity, a casting tube projecting into said continuous casting mould and sealed relative to said inner walls, an extraction means including driving rolls provided for said metal strand as it emerges from a run-out end of said continuous casting mould, and a transporting means including means for moving said transporting means reciprocatingly in the longitudinal direction of said continuous casting mould, the improvement comprising a coolable closure piece being selectively insertable into and removable from a position between said run-out end and said extraction means in a direction transverse to said longitudinal direction of said mould for selectively closing and opening said mould cavity, and a run-out roller table following upon said driving rolls in the strand extraction direction and including rollers arranged immediately after said driving rolls, said rollers being removable from said run-out roller table, and wherein said transporting means comprises means for mounting said continuous casting mould and said extraction means on said transporting means.

4. An arrangement as set forth in claim 3, further comprising a guide directed transverse to the axis of said continuous casting mould, said closure piece of said continuous casting mould being displaceable along said guide from a position closing said continuous casting mould into a position laterally thereof and vice versa.

5. An arrangement as set forth in claims 2 or 3, wherein said rollers are lowerable from said run-out roller table.

6. An arrangement as set forth in claims 2 or 3, wherein said casting tube comprises a bottom provided with at least one outflow opening for the metal melt.

* * * * *